US007445562B2

(12) United States Patent
Sano

(10) Patent No.: US 7,445,562 B2
(45) Date of Patent: Nov. 4, 2008

(54) GOLF PUTTER HEAD

(75) Inventor: Yoshinori Sano, Kobe (JP)

(73) Assignee: SRI Sports Ltd., Kobe-Shi (JP)

( * ) Notice: Subject to any disclaimer, the term of this patent is extended or adjusted under 35 U.S.C. 154(b) by 250 days.

(21) Appl. No.: 11/202,067

(22) Filed: Aug. 12, 2005

(65) Prior Publication Data

US 2006/0040765 A1 Feb. 23, 2006

(30) Foreign Application Priority Data

Aug. 19, 2004 (JP) ..... 2004-239850

(51) Int. Cl.
*A63B 53/04* (2006.01)

(52) U.S. Cl. ..... 473/332; 473/340; 473/341

(58) Field of Classification Search ..... None
See application file for complete search history.

(56) References Cited

U.S. PATENT DOCUMENTS

| | | | | |
|---|---|---|---|---|
| 1,960,110 | A * | 5/1934 | Iles | 473/286 |
| 3,716,239 | A * | 2/1973 | Goudreau | 473/256 |
| 4,123,056 | A * | 10/1978 | Nakamatsu | 473/234 |
| 4,248,430 | A * | 2/1981 | Kepler | 473/285 |
| 5,176,379 | A * | 1/1993 | Reinberg | 473/243 |
| 5,820,481 | A * | 10/1998 | Raudman | 473/313 |
| 5,993,325 | A * | 11/1999 | Heyer | 473/256 |
| 6,309,311 | B1 * | 10/2001 | Lu | 473/332 |
| 6,350,208 | B1 * | 2/2002 | Ford | 473/249 |
| 6,375,583 | B1 | 4/2002 | Solheim | |
| 7,048,646 | B2 * | 5/2006 | Yamanaka et al. | 473/332 |
| 7,344,451 | B2 * | 3/2008 | Tang et al. | 473/340 |
| 7,354,356 | B2 * | 4/2008 | Yamanaka et al. | 473/332 |
| 2006/0100028 | A1 * | 5/2006 | Kuo | 473/334 |

FOREIGN PATENT DOCUMENTS

JP 2002-200203 A 7/2002

OTHER PUBLICATIONS

Callister, Jr. William D. Materials Science and Engineering. New York: John Wiley & Sons, Inc. copyright 1997. pp. 113-116.*

* cited by examiner

*Primary Examiner*—Gene Kim
*Assistant Examiner*—Alvin A Hunter
(74) *Attorney, Agent, or Firm*—Birch, Stewart, Kolasch & Birch, LLP

(57) ABSTRACT

A golf putter head includes: a head body having a face surface; and a different member fixed to the head body and having a plurality of end portions as fixed portions to the head body, and a spaced extension extended between the end portions and spaced away from the head body, the different member fixed to the head body as elastically deformed by being fixed to the head body in a manner that the end portions thereof have a relative positional relation varied from that when the different member is in an independent piece state.

12 Claims, 3 Drawing Sheets

GOLF PUTTER HEAD

BACKGROUND OF THE INVENTION

The present invention relates to a golf putter head.

Recently, a head of a composite structure combining different types of members having different specific gravities, hardnesses or the like has become predominant in the golf club head, or particularly in the putter head. For instance, Japanese Unexamined Patent Publication No. 2002-200203 has proposed a putter head wherein metal pieces having a higher specific gravity than a head body are disposed on a toe-side and a heel-side of the head, respectively, and wherein a non-metal material, such as polyurethane, is attached to a face surface of the head.

OBJECT AND SUMMARY OF THE INVENTION

According to the aforementioned prior art, a different member having a different specific gravity than that of the head body is embedded in the head body. Therefore, in comparison to a case where the different member is projected from the head body or extended as spaced away therefrom, the provision of the different member is not so effective as expected to increase the freedom of designing weight distribution or centroid position.

As suggested by a golf putter head 10 shown in FIG. 2B, for example, it may be contemplated to increase the freedom of designing weight distribution or centroid position by adopting an arrangement wherein a part of a different member 12 defines a spaced extension 13 extended from the head body 11 as spaced therefrom. However, since the spaced extension 13 is spaced away from the head body 11 and is not supported by the head body 11, some ball impact points may produce a state where the spaced extension 13 is prone to resonant vibration due to impact with a ball. There is another problem. Since the spaced extension 13 of the different member 12 may be brought into the resonant vibration or not depending upon the ball impact points, the roll distance or hit feel varies greatly. In addition, such a resonant vibration increases the likelihood that screws will become loose or an adhesive will be deteriorated in conjunction with an increasing number of times to strike balls, while the head body 11 is lowered in fixing strength to finally encounter the disengagement of the different member 12 therefrom.

In view of the foregoing, the invention has been accomplished. It is an object of the invention to provide a golf putter head of a composite structure wherein a part of the different member is spaced away from the head body, the head designed to minimize the resonant vibration at the spaced portion According to the invention, a golf putter head comprises: a head body having a face surface; and a different member having a plurality of end portions as fixed portions to the head body, having a spaced extension extended between the end portions and spaced away from the head body, and being fixed to the head body as elastically deformed by being fixed in a manner that the end portions thereof have a relative positional relation varied from that when the different member is in an independent piece state.

Since the different member includes the spaced extension, the golf putter head is increased in the freedom of designing the centroid position, the weight distribution and the like. Furthermore, the spaced extension is fixed to the head body as elastically deformed and hence, internal stress remaining in the elastically deformed portion makes the spaced extension less prone to the resonant vibration.

It is preferred in the golf putter head that the head body includes a plurality of end mount holes in which the end portions of the different member are inserted and which restrict the positions of the end portions in a manner that the end portions have the relative positional relation varied from that when the different member is in the independent piece state. In this case, the plural end portions of the different member may simply be inserted in the end mount holes formed in the golf putter head, respectively, whereby the positional relation between the end portions of the different member may be varied from that when the different member is in the independent piece state. It is therefore quite easy to fabricate the head having the different member elastically deformed.

It is preferred that the plural end mount holes are disposed on a toe-side and a heel-side of a back surface of the head body, and that the spaced extension of the different member is spaced backward of the head body and bendingly extends from the toe-side to the heel-side of the head body. In this case, the spaced extension is located on the toe-side, the heel-side and the back side of the head and hence, the head may be increased in inertial moment in transverse direction (inertial moment about a perpendicular line through the centroid of the head when a golf putter head 1 is placed on a horizontal plane at a predetermined lie angle, or also referred to as transverse inertial moment). Furthermore, the head may also have a centroid depth deepened. Accordingly, the golf putter head may feature stable strokes. In this case, the spaced extension may also be arranged to bendingly extend substantially along a circular, elliptical, or polygonal shape. This arrangement facilitates the distribution of the weight of the spaced extension to a head periphery, so that it becomes easier to increase the inertial moment and the centroid depth of the head. In addition, the head may be so configured as to present less sense of incongruity.

It is preferred to make an arrangement wherein a specific gravity of the different member is greater than a specific gravity of the head body because it becomes easier to increase the centroid depth and the inertial moment of the head.

DESCRIPTION OF THE PREFERRED EMBODIMENTS

The preferred embodiments of the invention will hereinbelow be described with reference to the accompanying drawings.

Figure 1:
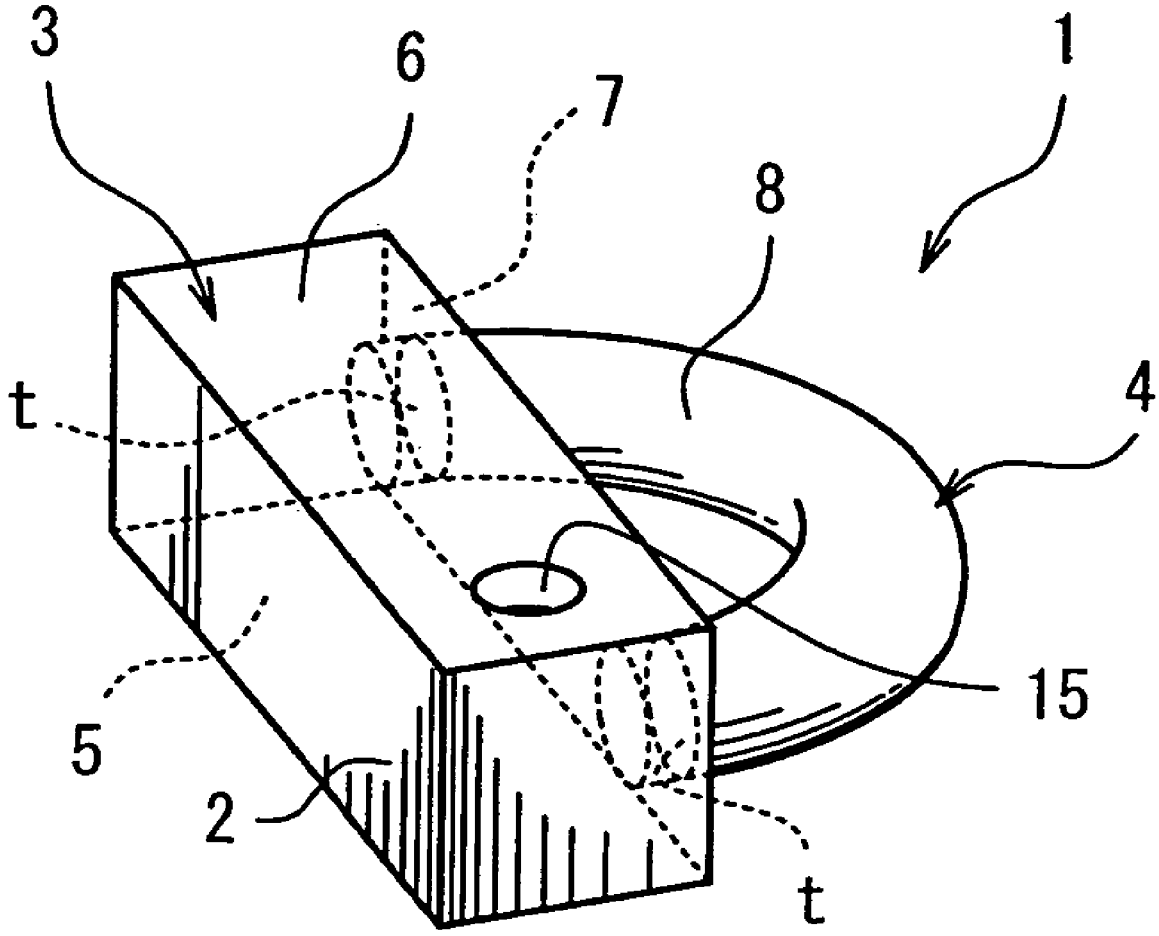
FIG. 1 is a perspective view of a golf putter head according to one embodiment of the invention.

FIG. 1 is a perspective view of a golf putter head 1 according to one embodiment of the invention. The golf putter head 1 includes: a head body 3 having a face surface 2 contacting a ball at impact with the ball; and a different member 4 which is independent from the head body 3 and is fixed to a back side of the head body 3.

The head body 3 generally defines a rectangular parallelepiped. Besides the aforesaid face surface 2, the head body further includes: a sole surface 5 defining a bottom surface of the golf putter head 1; a top surface 6 defining an upper surface of the golf putter head 1; and a back surface 7 located on the opposite side from the face surface 2. Disposed on a heel-side of the top surface 6 is a shaft hole 15 for insertion and fixing of an unillustrated shaft.

On the other hand, the different member 4 is a bar-like member formed by bending a round bar into a semicircular arch, the bar having a circular section. The different member includes: end portions t defining fixed portions to the head body and constituting longitudinally opposite ends of the different member 4; and a spaced extension 8 extended between these opposite end portions t as spaced from the head body 3. The spaced extension 8 of the different member 4 is spaced backward of the head body and bendingly extends from a toe-side to a heel side of the golf putter head 1 with respect to a plane substantially along the sole surface 5.

Figure 2A:
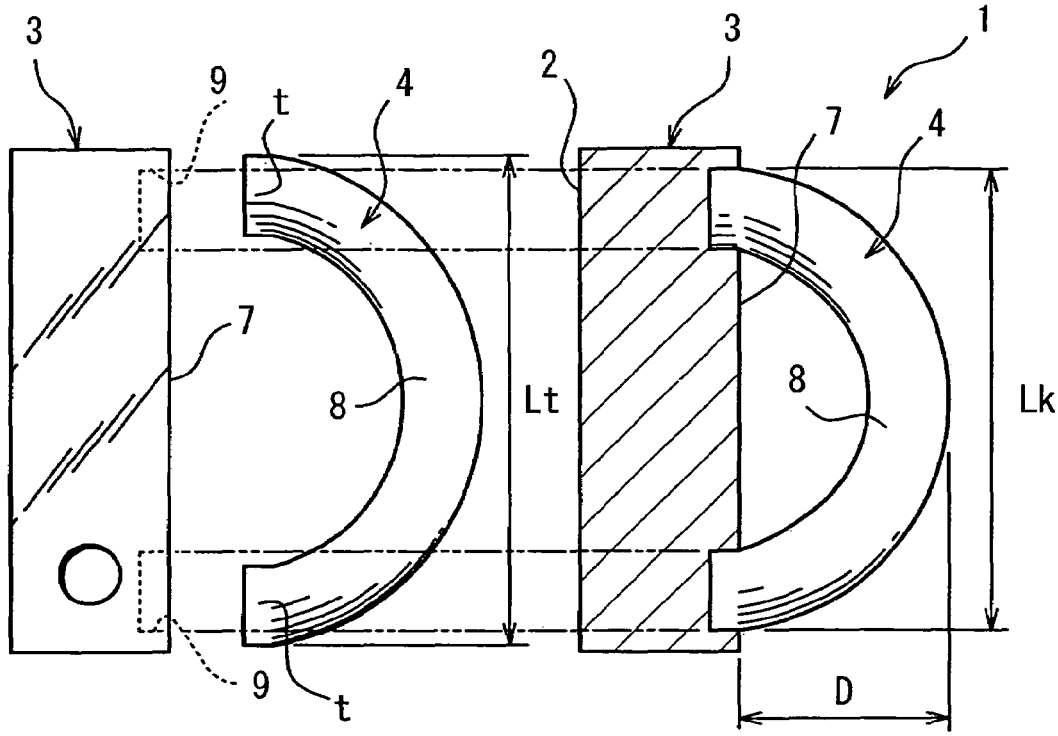
FIG. 2A is a diagram of a head body and a different member according to the embodiment and example of the invention for contradistinguishing a state where the head body and the different member are separated from each other from a state where the head body and the different member are combined together.

FIG. 2A is a diagram showing a state where the head body 3 and the different member 4 of the golf putter head 1 are separated from each other (the left-hand portion of the figure) and a state where the head body 3 and the different member 4 are fixed to each other to complete the golf putter head 1 (the right-hand portion of the figure). The head body 3 is formed with end mount holes 9 at places on a toe-side and a heel-side of the back surface thereof for insertion of the respective end portions t of the different member 4. The end portions t of the different member 4 are inserted in and fixed to the end mount holes 9, respectively.

The different member 4 is fixed to the head body 3 as elastically deformed. It is assumed that a toe-heel length of the different member 4, which is separated from the head body 4 or in a state of one independent piece, is defined as an independent piece length Lt, and that the toe-heel length of the different member 4 which is fixed to the head body 3 is defined as a fixed piece length Lk. The independent piece length Lt is greater than the fixed piece length Lk (see FIG. 2A). That is, the different member 4 is fixed to the head body 3 as elastically deformed by an amount of [(independent piece length Lt)−(fixed piece length Lk)]. The independent piece length Lt means the toe-heel length of the different member 4 unconfined by the head body 3 (in a free state or in an independent piece state). The independent piece length Lt can be measured by separating the different member 4 from the head body 3 in the completed golf putter head 1. The different member 4 fixed to the head body 3 is constantly subjected to internal stress resulting from a restoring force acting to bring the different member 4 back to the shape in the independent piece state. In the golf putter head 1, the different member 4 is fixed to the head body 3 in a manner that the end portions t of the different member 4 have a relative positional relation varied from that when the different member 4 is in the independent piece state, whereby the different member 4 is fixed to the head body 3 as elastically deformed. It is relatively easy to elastically deform the different member 4 because the member is a bar-like member.

The end portions t of the different member 4 are fixed to the head body 3 with an adhesive. That is, inside surfaces of the end mount holes 9 and outside surfaces of the end portions t are fixed to each other by means of the adhesive. This method is preferred because a fixing strength between the different member 4 and the head body 3 is further increased. The adhesive may be any suitable one of the adhesives commonly used in the art for fixing the golf club head and the shaft to each other. Examples of the suitable adhesive include epoxy adhesives, acrylic adhesives, urethane adhesives and the like.

A total of two end mount holes 9 disposed on the toe-side and the heel-side of the head body 3 are shaped substantially in conformity with a sectional shape of the end portions t of the different member 4, so as to define a minimum clearance between the end mount hole 9 and the end portion t. The toe-heel length of the different member 4 is restricted to the fixed piece length Lk by inserting the end portions t of the different member 4 into the two end mount holes 9. In this manner, the end mount holes 9 confine the end portions t of the different member 4 to such positions that the end portions t have the relative positional relation varied from that when the different member 4 is in the independent piece state.

It is preferred that a ratio between the aforesaid independent piece length Lt and the fixed piece length Lk [(independent piece length Lt)/(fixed piece length Lk)] is in the range of 1.01 to 1.2. If the ratio is less than 1.01, the stress remaining in the different member 4 is so small that the invention tends to provide an insufficient effect to reduce the variations of hit feel. Therefore, the ratio is more preferably 1.02 or more. If the ratio [(independent piece length Lt)/(fixed piece length Lk)] exceeds 1.2, an operation of assembling the different member to the head body may be lowered in efficiency or the different member 4 may be prone to plastic deformation. Therefore, the ratio is even more preferably 1.1 or less, and particularly preferably 1.05 or less.

The fixed piece length Lk is preferably in the range of 30 mm to 150 mm. If the length is less than 30 mm, the transverse inertial moment is so small that the head tends to be inferior in the directionality of hit ball. Therefore, the fixed piece length Lk is more preferably 40 mm or more, even more preferably 50 mm or more, and particularly preferably 70 mm or more. If, on the other hand, the fixed piece length Lk is too great, the head may have an excessive weight and an excessive size, which may result in an instable putting stroke. Therefore, the fixed piece length Lk is more preferably 140 mm or less, particularly preferably 120 mm or less and most preferably 100 mm or less.

A positional depth length D of the different member 4 is preferably in the range of 40 mm to 150 mm, the positional depth length D defined by a face-back length of the different member 4 (a length from a position on the back surface 7 to a back-side apex of the assembled different member 4 as seen in the golf putter head 1 of the embodiment). If the positional depth length D is less than 40 mm, the transverse inertial moment is so small that the head tends to be inferior in the directionality of hit ball. Therefore, the positional depth length is more preferably 60 mm or more, and particularly preferably 80 mm or more. If the positional depth length D exceeds 150 mm, the head has an excessive size and weight, which may result in the instable stroke. Therefore, the positional depth length D is more preferably 130 mm or less, and particularly preferably 110 mm or less.

In the golf putter head 1 of the aforementioned arrangement, the spaced extension 8 of a substantially semicircular shape is spaced away from the head body 3 and extends from the heel-side to the toe-side of the head body 3. As spaced from the head body 3, the spaced extension 8 extends along a route deflected backward of the head body 3 in correspondence to the space therebetween. Therefore, the weight of the golf putter head 1 is distributed to the toe-side and the heel-side thereof, and also to the back side thereof. Hence, the transverse inertial moment of the golf putter head 1 is expanded while the centroid depth thereof is also deepened.

In this case, some ball impact point is more likely to allow the ball impact to cause the resonant vibration because the spaced extension 8 is spaced away from the head body 3. However, such a resonant vibration may be minimized because the spaced extension 8 is constantly subjected to the aforementioned internal stress (restoring force). Thus are minimized the variations of the roll distance or of the sense of distance, which result from the different member 4 experiencing the resonant vibration or not depending upon the ball impact points. In addition, the decrease of the fixing strength of the different member 4 due to the resonant vibration is also suppressed.

The head body 3 is formed with the end mount holes 9 for restricting the positions of the end portions t of the different member 4 in a manner that the end portions t have the relative positional relation varied from that when the different member 4 is in the independent piece state. Therefore, the golf putter head 1 may be fabricated easily by inserting the individual end portions t into the respective end mount holes 9 while elastically deforming the different member 4.

Materials for the head body 3 and the different member 4 are not particularly limited. Any suitable materials used in the common golf putter heads may be used. However, at least the different member 4 must be formed from an elastically deformable material because the different member 4 must be fixed to the head body 3 as elastically deformed. In the state where the head body 3 is fixed to the different member 4, the relative positional relation between the end portions t as the fixed portions need be set within such a range that the different member 4 can be elastically deformed (the range of elasticity of the different member 4).

Preferably, an arrangement may be made such that a specific gravity of the different member 4 (the specific gravity of a material constituting the different member 4, or an average specific gravity of the overall different member 4 in a case where the different member 4 is a combination of different types of materials) is greater than that of the head body 3 (the specific gravity of a material constituting the head body 3 or an average specific gravity of the overall head body 3 in a case where the head body 3 is a combination of different types of materials). Such an arrangement makes it easier to increase the centroid depth and inertial moment of the golf putter head 1.

The specific gravity of the head body 3 is preferably 0.5 or more as a lower limit and preferably 5.0 or less as an upper limit. If the specific gravity is less than 0.5, the head body 3 is lowered in strength so that the durability of the head is lowered. Accordingly, the specific gravity of the head body is more preferably 1.0 or more, and particularly preferably 2.0 or more. The upper limit is defined to be 5.0 or less for the following reason. If the specific gravity of the head body 3 exceeds 5.0, the different member 4 is reduced in the weight because of the restriction on the total weight of the head. This leads to a tendency that the head is decreased in the inertial moment. Hence, the specific gravity of the head body is more preferably 4.7 or less, and particularly preferably 4.0 or less.

The specific gravity of the different member 4 is preferably 5.1 or more as a lower limit, and preferably 18.0 or less as an upper limit. If the specific gravity of the different member is less than 5.1, the head may not be sufficiently increased in the inertial moment. Therefore, the specific gravity is preferably 6.5 or more, and particularly preferably 7.5 or more. If, on the other hand, the specific gravity exceeds 18.0, the head tends to be inclined when the head is soled at address. Hence, the head may not be stabilized. Accordingly, the specific gravity is more preferably 13.0 or less, and particularly preferably 10.0 or less.

The value of [(the specific gravity of the different member)−(the specific gravity of the head body)] is preferably 3 or more as a lower limit, and preferably 16 or less as an upper limit. If the value is less than 3, there may not be attained a sufficient effect to increase the inertial moment of the head and to deepen the centroid depth thereof. Accordingly, the value is more preferably 3.5 or more, and particularly preferably 4.0 or more. If the value exceeds 16, the head tends to be inclined when the head is soled at address. Hence, the head may not be stabilized. Accordingly, the value is more preferably 12 or less, and particularly preferably 8 or less.

In the light of the above preferred range of the specific gravity, preferred materials for use in the head body 3 or the different member 4 may be exemplified by the followings. Examples of the preferred material for the head body 3 include: titanium and titanium alloys (specific gravities on the order of 4.7); aluminum and aluminum alloys (specific gravities on the order of 2.7); magnesium and magnesium alloys (specific gravities on the order of 1.9); and the like. Among these, aluminum alloys are particularly preferred from the viewpoint of workability and costs. Examples of the preferred material for the different member 4 include: stainless steel alloys (specific gravities on the order of 7.8); tungsten (specific gravity on the order of 18); irons such as soft-irons and iron-based alloys (specific gravities on the order of 7.9); tungsten-nickel (specific gravity on the order of 4.7); tungsten-copper (specific gravity on the order of 14); copper (specific gravity on the order of 8.9); nickel (specific gravity on the order of 8.9); and the like. Among these, stainless steel is particularly preferred from the viewpoint of workability and costs.

While the aforementioned embodiment is formed with the end mount holes 9, such end mount holes 9 may be dispensed with. For instance, the different member 4 may be free from the end mount holes 9 and may have the end portions t thereof fixed to the head body 3 only by way of welding or bonding. Restricting means such as steps, for example, may be employed instead of the holes such as the end mount holes 9 for restricting the positions of the end portions t of the different member 4 in a manner that the end portions t have the relative positional relation varied from that when the different member 4 is in the independent piece state.

In the light of ease of fabrication, the different member 4 may preferably be configured to include the two end portions t at the longitudinally opposite ends thereof, as suggested by the golf putter head 1 of the above embodiment.

Figure 3A:
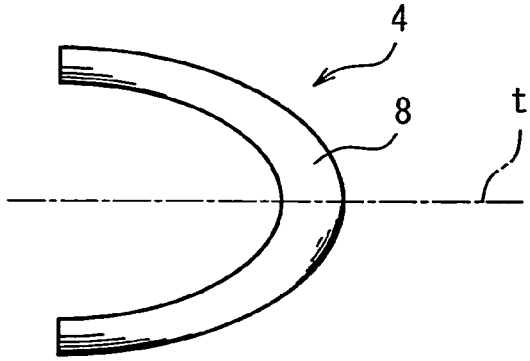
FIG. 3A, FIG. 3B, FIG. 3C and FIG. 3D are diagrams each showing a modification of the shape of a spaced extension of the different member.
Figure 3B:
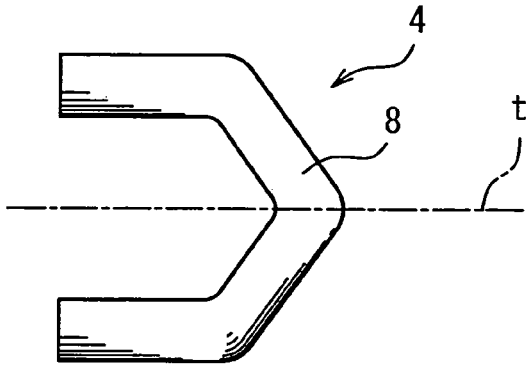
Figure 3C:
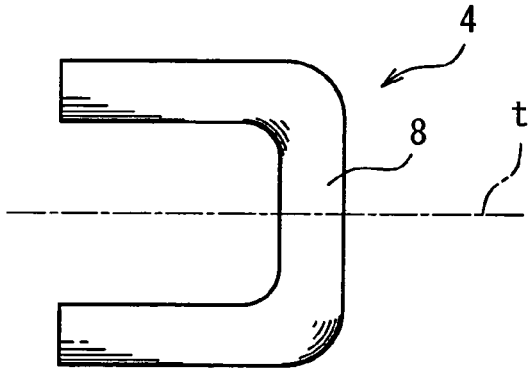
Figure 3D:
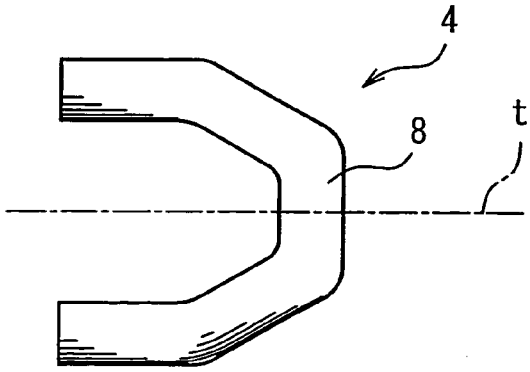

The shape (general configuration) of the spaced extension 8 of the different member 4 is not particularly limited and may have various shapes. Particularly, the spaced extension 8 bendingly extending substantially in a circular shape as illustrated by the above embodiment is preferred in that the weight of the spaced extension 8 tends to be distributed to a peripheral side of the head or particularly to the back side thereof so that the inertial moment and the centroid depth may be increased easily, and in that the head has a shape (the general configuration) presenting relatively less sense of incongruity. The following spaced extensions are also preferred for the same reason, which include one which bendingly extends substantially in an elliptical shape as shown in FIG. 3A, and those which bendingly extend substantially in polygonal shapes as shown in FIG. 3B, FIG. 3C and FIG. 3D. A modification of the spaced extension 8 shown in FIG. 3A substantially defines a semi-elliptical shape. This configuration is adapted to distribute a greater proportion of the weight to the back side of the head than the substantially semicircular configuration of the embodiment shown in FIG. 2A. Therefore, this configuration is preferred in that the centroid depth may be further deepened. FIG. 3B illustrates a modification of the spaced extension which extends substantially along (four continuous sides of) an equilateral hexagonal shape. FIG. 3C illustrates a modification of the spaced extension which extends substantially along (three continuous sides of) an equilateral quadrangular shape. FIG. 3D illustrates a modification of the spaced extension which extends substantially along (five continuous sides of) an equilateral octagonal shape. The spaced extensions bendingly extending substantially along equilateral polygonal shapes, out of the polygonal shapes, are preferred in that those shapes present less sense of incongruity.

Figure 2B:
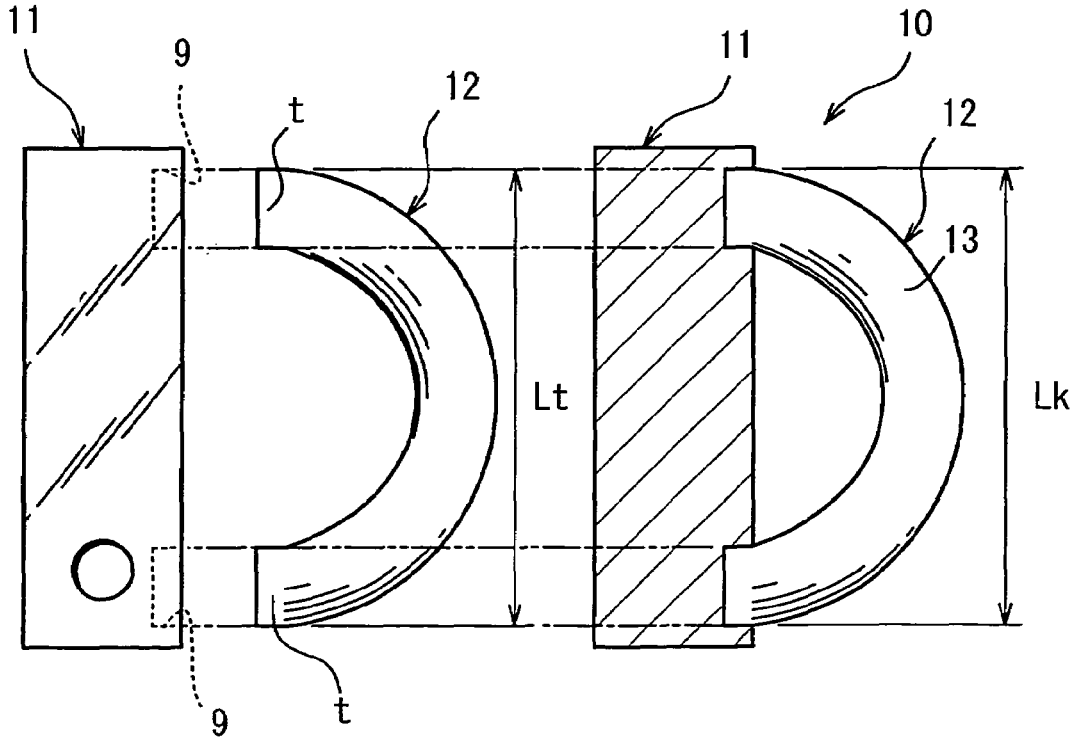
FIG. 2B is a diagram of a head body and a different member according to a comparative example for contradistinguishing a state where the head body and the different member are separated from each other from a state where the head body and the different member are combined together.

As suggested by the embodiments shown in FIG. 2A and FIG. 2B and the modifications shown in FIG. 3A through FIG. 3D, the spaced extension 8 may preferably have the general configuration symmetrical with respect to a line t (see FIG. 3A through FIG. 3D) perpendicular to the face surface 2 and passing through the toe-heel center of the spaced extension 8, because the weight thereof can be substantially equally distributed to the toe-side and the heel-side of the head so that a sweet area may be substantially equally expanded from the toe-heel center of the face surface 2 toward the toe-side and the heel-side thereof. Furthermore, such configurations present less sense of incongruity.

In the modification of FIG. 3A, the sectional area of the spaced extension 8 (the area of section perpendicular to the longitudinal direction of the spaced extension 8) is progressively increased from the face side toward the back side. This configuration is preferred because the centroid depth is further deepened.

A sectional shape of the different member 4 (the shape of section perpendicular to the longitudinal direction of the different member 4) is not particularly limited and may include circular shapes, elliptical shapes, rectangular shapes, hexagonal shapes such as an equilateral hexagon, triangular shapes such as an equilateral triangle, other polygonal shapes and the like. Among these, a different member having a circular section is preferred because such a different member is less susceptible to strain due to bending for manufacturing the different member, and also has good workability. Where the different member has the circular section, the aforesaid end mount holes 9 may also be formed to have a circular section. This also leads to a merit of facilitating the formation of the end mount holes 9. The different member 4 may have the same sectional shape or area, or different sectional shapes or areas with respect to individually different longitudinal points. If the different member 4 has the same sectional shape or area with respect to the individually different longitudinal points, the different member may be manufactured simply by bending a general-purpose bar-like member. Therefore, such a different member is preferred from the viewpoint of manufacture costs. On the other hand, the different member 4 progressively increased in the sectional area toward the back side with respect to the head is preferred because the centroid depth may be deepened easily.

The method of manufacture of the different member 4 is not particularly limited and may be manufactured by forging or casting (lost wax precision casting). Alternatively, the different member may be manufactured by bending the bar-like member. Particularly, the method of bending the bar-like member is preferred because the method features high productivity and low costs.

The invention does not particularly limit the method of manufacture of the head. What the invention requires is that the different member 4 is fixed to the head body 3 as elastically deformed in the final state where the different member 4 is assembled into the golf putter head. The invention does not specify a particular point of time to subject the different member 4 to the elastic deformation in the process of manufacturing the head. Therefore, the different member 4 may be fixed to the head body 3 while elastically deforming the different member. Otherwise, the different member 4 may be fixed to the head body 3 without being elastically deformed, and thereafter, the strain may be applied to the different member 4 by heating or deforming so as to produce the internal stress therein. According to the golf putter head 1 of the embodiment shown in FIG. 2A, the independent piece length Lt is greater than the fixed piece length Lk. Conversely, the independent piece length Lt may be smaller than the fixed piece length Lk whereby the different member 4 is set in the elastically deformed state. In the light of the easiness of manufacturing the head, however, it is preferred to adopt the manufacture method wherein a plurality of end mount holes 9 are formed in the head body 3 for restricting the positions of the end portions of the different member 4 in a manner that the end portions have the relative positional relation varied from that when the different member 4 is in the independent piece state prior to the fixation to the head body 3, and wherein the end portions t of the different member 4 are inserted into the end mount holes 9 of the head body 3 while elastically deforming the different member for bringing the end portions t into the relative positional relation corresponding to the end mount holes 9.

The head weight (the total weight of the complete golf putter head) is preferably 280 g or more as a lower limit, and preferably 500 g or less as an upper limit. If the head weight is less than 280 g, the club balance is so light as to decrease the ease of stroke. Accordingly, the head weight is more preferably 310 g or more, and particularly preferably 340 g or more. If, on the other hand, the head weight exceeds 500 g, the total club weight and the club balance are so great as to decrease the ease of stroke. Accordingly, the head weight is more preferably 480 g or less, and particularly preferably 420 g or less.

Evaluation Based on Examples

Samples of the examples of the invention and a comparative example were fabricated to confirm the effects of the invention.

Putter heads of all the examples and comparative example (hereinafter, also called "all the examples") were each fabricated by combining together the head body substantially in the form of a rectangular parallelepiped and the different member having a circular section and a substantially semicircular shape, as shown in FIG. 1 and FIG. 2A. The head bodies of all the examples were formed as identical as possible. In a test of the putter heads assembled into clubs, all the examples each used a common steel shaft and a common grip (grip weight: 70 g) which were assembled with the head. Thus, golf putter clubs having a club length of 34 inches were fabricated and tested.

As to a material for the head body, Example 4 used stainless steel whereas the other examples and the comparative example used an aluminum alloy. As to a material for the different member, Examples 1 to 3, Examples 6 to 8 and Comparative Example 1 used a stainless steel alloy. Example 4 used tungsten-nickel, and Example 5 used a titanium alloy. In the examples other than Example 5, the heads had the same weight of 355 g. In Example 4, however, the head was decreased volume to equalize the head weight to that of the heads of Examples and such.

The methods of manufacture of the heads of the examples are described as below.

In Examples 1, 4, 5, 7 and 8, the end portions t of the different member 4 were inserted into the end mount holes 9 of the head body 3 while elastically deforming the different member 4. The head was fabricated without using fixing means such as an adhesive or weld. In this case, therefore, the different member 4 is fixed to the head body 3 solely by way of the restoring force due to the elastic deformation of the different member.

In Example 2, on the other hand, the head was fabricated using the above method of Example 1 and also using an adhesive for fonding the outside surfaces of the end portions t of the different member 4 to the inside surfaces of the end mount holes 9.

In Example 3, the head was fabricated using the method of Example 2 (fixing by way of the restoring force and the adhesive) and also using screws for fastening the different member 4 to the head body 3.

FIG. 2B illustrate a fabrication method of Comparative Example 1. In this example, the different member 12 is previously manufactured. The end portions t of the different member 12 in the independent piece state have a relative positional relation in correspondence to that of the end mount holes 9 of the head body 11. Hence, the different member 12 is fixed to the head body 11 without elastically deforming the different member. In Comparative Example 1, therefore, the independent piece length Lt is equal to the fixed piece length Lk, so that the different member 12 free from the elastic deformation is fixed to the head body 11. Similarly to Example 2, Comparative Example 1 uses the adhesive.

In the above examples using the adhesive, the adhesive was Hard Lock G55 (Trade-name) commercially available from DENKI KAGAKU KOGYO KABUSHIKIKAISHA.

The specifications and evaluation results of the examples are listed in Table 1.

TABLE 1

| | Ex. 1 | Ex. 2 | Ex. 3 | Ex. 4 | Ex. 5 | Ex. 6 | Ex. 7 | Ex. 8 | CEx. 1 |
|---|---|---|---|---|---|---|---|---|---|
| SGHB | 2.7 | 2.7 | 2.7 | 7.8 | 2.7 | 2.7 | 2.7 | 2.7 | 2.7 |
| SGDM | 7.8 | 7.8 | 7.8 | 10.0 | 4.7 | 7.8 | 7.8 | 7.8 | 7.8 |
| SGDM-SGHB | 5.1 | 5.1 | 5.1 | 2.2 | 2.0 | 5.1 | 5.1 | 5.1 | 5.1 |
| Diameter of circular section of DM | 10 | 10 | 10 | 10 | 10 | 10 | 10 | 10 | 10 |
| (IPL/FPL) of DM | 1.02 | 1.02 | 1.02 | 1.02 | 1.02 | 1.05 | 1.01 | 1.02 | 1.00 |
| DM length at fixation (mm) | 100 | 100 | 100 | 50 | 100 | 100 | 100 | 70 | 100 |
| Depth length (mm) | 67 | 67 | 67 | 30 | 67 | 67 | 67 | 80 | 67 |
| Head weight (g) | 355 | 355 | 355 | 355 | 240 | 355 | 355 | 355 | 355 |
| Transverse inertial moment ($g \cdot cm^2$) | 4500 | 4500 | 4500 | 3500 | 3500 | 4500 | 4500 | 4650 | 4500 |
| Centroid depth (mm) | 35 | 35 | 35 | 24 | 30 | 35 | 35 | 37 | 35 |
| Hit feel | 3.5 | 3.6 | 3.5 | 3.5 | 3.6 | 3.9 | 3.1 | 3.5 | 2.3 |
| Durability A | 130 | 160 | 180 | 135 | 135 | 140 | 125 | 135 | 100 |
| Durability B | 130 | 145 | 180 | 135 | 135 | 140 | 120 | 130 | 100 |

Note:
SGHB denotes "specific gravity of head body"; SGDM denotes "specific gravity of different member"; DM denotes "different member"; IPL denotes "independent piece length"; and FPL denotes "fixed piece length".

"Hit feel" in Table 1 was evaluated as follows. Ten golfers handicapped at 10 to 20 each used each of the clubs to putt 10 balls on a green from place 5 m away from a target. Each of the golfers made the following five-grade evaluations on the hit feel. Evaluation results were obtained by averaging the values given by the ten golfers. The higher evaluation value means the better hit feel:

5: a small ball impact;

4: a relatively small ball impact;

3: a normal ball impact;

2: a relatively great ball impact; and

1: a great ball impact.

Now, description is made on "Durability A" and "Durability B" in Table 1.

"Durability A" means the number of vibrations to produce looseness between the head body 3 and the different member 4 in a case where a vibration tester applies 20 Hz-vibrations to the head. The number of vibrations is converted into an index number based on 100 representative of the number of vibrations of Comparative Example 1. The vibration tester has an arrangement wherein a fixing jig capable of fixing the head at a predetermined lie angle is provided on a table adapted for vertical and transverse vibrations. In this test, the head of each example was fixed on the table of the vibration tester at the predetermined lie angle and was tested by applying thereto the vertical and transverse vibrations.

"Durability B" means the number of vibrations to produce looseness between the head body 3 and the different member 4 and is determined as follows. Each head is allowed to stand for 240 hours in an environment at a temperature of 50° C. and moisture of 90%. Subsequently, the head is subjected to the vibration tester used in the determination of "Durability A", which applies the same 20-Hz vibrations as in the determination of "Durability A" to the head. The number of vibrations is converted into an index number based on 100 representative of the number of vibrations of Comparative Example 1.

"Specific gravity of different member—Specific gravity of head body" in Table 1 means a value obtained by subtracting the specific gravity of the head body from the specific gravity of the different member. "(Independent piece length/Fixed piece length) of Different member" means a value obtained by dividing the independent piece length Lt shown in FIG. 2A and FIG. 2B by the fixed piece length Lk shown in FIG. 2A and FIG. 2B. "Different-member length at fixation" means the fixed piece length Lk shown in FIG. 2A and FIG. 2B. "Depth length" means the depth length D shown in FIG. 2A. "Transverse inertial moment" means as described above.

Example 4, in particular, has a smaller value of transverse inertial moment than Example 1 and the like although both the specific gravity of head body and the specific gravity of different member of Example 4 are at relatively great values.

This is because a head volume of Example 4 is smaller than those of Example 1 and the like.

Of the above examples, the heads of the examples of the invention were also evaluated for stroke stability. That is, "Stroke stability" in Table 2 was determined as follows. Ten golfers handicapped at 10 to 20 each used each of the clubs to putt 10 balls on the green from place 5 m away from the target. Each of the golfers made the following five-grade evaluations on the stroke stability. Evaluation results were obtained by averaging the values given by the ten golfers. The higher evaluation value means the more stable stroke:

5: an extremely stable stroke;
4: a stable stroke;
3: a normal stroke;
2: an instable stoke; and
1: an extremely instable stroke.

The results are listed in Table 2 as below.

TABLE 2

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Stroke stability | 4.0 | 3.8 | 3.8 | 2.3 | 2.0 | 4.1 | 3.7 | 3.0 |

As shown in the above tables, the examples achieve better durabilities and hit feels than the comparative example. As to the durabilities, the examples not using the adhesive achieve better durabilities than the comparative example using the adhesive, because the resonant vibrations are more suppressed in the examples than in the comparative example.

The invention claimed is:

1. A golf putter head comprising:

a head body having a face surface; and a different member having end portions thereof fixed to the head body and an spaced extension extended between the end portions and spaced away from the head body; and wherein the different member, when not subjected to stress, having a bent shape with a first spacing between the end portions, and, when assembled to the head body, being elastically deformed to and held in a stressed state and an altered bent shape in which the spacing between the end portions differs from the first spacing.

2. A golf putter head according to claim 1, wherein the head body includes a plurality of end mount holes in which the end portions of the different member are inserted and which hold the end portions in a manner that the the different member is maintained in the the stressed state and the altered bent shape

3. A golf putter head according to claim 2, wherein the plural end mount holes are disposed on a toe-side and a heel-side of a back surface of the head body, and wherein the spaced extension of the different member is spaced backward of the head body and bendingly extends from the toe-side to the heel-side of the head body.

4. A golf putter head according to claim 3, wherein the spaced extension bendingly extends substantially along a circular, elliptical, or polygonal shape.

5. A golf putter head according to claim 4, wherein a specific gravity of the different member is greater than a specific gravity of the head body.

6. A golf putter head according to claim 3, wherein a specific gravity of the different member is greater than a specific gravity of the head body.

7. A golf putter head according to claim 2, wherein a specific gravity of the different member is greater than a specific gravity of the head body.

8. A golf putter head according to claim 2, wherein the different member is fixed to the head body by a restoring force resulting from the elastic deformation of the different member.

9. A golf putter head according to claim 1, wherein a specific gravity of the different member is greater than a specific gravity of the head body.

10. A golf putter head according to claim 1, wherein the end portions of the different member are fixed to the head body with adhesive.

11. A golf putter head according to claim 1, wherein the end portions of the different member are fixed to the head body by welding.

12. A golf putter head according to claim 1, wherein a ratio of the first spacing between the end portions to the spacing between the end portions after the different member is assembled to the head body is in the range of 1.01 to 1.2.

* * * * *